US009339104B2

(12) United States Patent
O'Neill

(10) Patent No.: US 9,339,104 B2
(45) Date of Patent: May 17, 2016

(54) FLEXIBLE HANDLE LIQUID DISPENSER WITH ROTATING BRUSH HEAD

(71) Applicant: Dennis L. O'Neill, Pittsburgh, PA (US)

(72) Inventor: Dennis L. O'Neill, Pittsburgh, PA (US)

( * ) Notice: Subject to any disclaimer, the term of this patent is extended or adjusted under 35 U.S.C. 154(b) by 0 days.

(21) Appl. No.: 13/948,064

(22) Filed: Jul. 22, 2013

(65) Prior Publication Data

US 2014/0099154 A1 Apr. 10, 2014

Related U.S. Application Data

(60) Provisional application No. 61/674,377, filed on Jul. 22, 2012.

(51) Int. Cl.

| | |
|---|---|
| ***A46B 5/00*** | (2006.01) |
| ***A46B 13/04*** | (2006.01) |
| ***A46B 5/02*** | (2006.01) |
| ***A46B 11/00*** | (2006.01) |
| ***A46B 11/06*** | (2006.01) |
| ***A46B 13/00*** | (2006.01) |

(52) U.S. Cl.

CPC ..... *A46B 13/04* (2013.01); *A46B 5/0033* (2013.01); *A46B 5/0075* (2013.01); *A46B 5/02* (2013.01); *A46B 11/0062* (2013.01); *A46B 11/066* (2013.01); *A46B 13/008* (2013.01); *A46B 5/005* (2013.01); *A46B 5/026* (2013.01); *A46B 2200/10* (2013.01)

(58) Field of Classification Search

CPC ..... A46B 5/0062; A46B 5/0066; A46B 5/007
USPC ..... 401/280, 281, 291
See application file for complete search history.

(56) References Cited

U.S. PATENT DOCUMENTS

| | | | | |
|---|---|---|---|---|
| 5,671,497 | A * | 9/1997 | Abdo | 15/144.1 |
| 6,132,126 | A * | 10/2000 | Sheffler et al. | 401/213 |
| 6,170,108 | B1 * | 1/2001 | Knight | 15/29 |
| 6,530,707 | B1 * | 3/2003 | Byrne et al. | 401/6 |
| 8,123,712 | B2 * | 2/2012 | Julius | 604/1 |
| 8,308,390 | B2 * | 11/2012 | Kao | A46B 11/0062 401/289 |
| 2011/0044750 | A1 * | 2/2011 | Houman | 401/268 |
| 2012/0183344 | A1 * | 7/2012 | Habinger | 401/184 |

* cited by examiner

*Primary Examiner* — Jennifer C Chiang
*Assistant Examiner* — Joshua Wiljanen
(74) *Attorney, Agent, or Firm* — Gary P. Topolosky

(57) ABSTRACT

A dispenser, liquid applicator with a flexible (hand-manipulated) gripping end and a second brush head end with rotatable bristles. It further includes an elongated central chamber into which may be added soap, shampoo, cleaner or another liquid/lotion for dispensing through a plurality of apertures in the brush head end. Rotation of the brush head bristles can be accomplished electrically (via a battery powered motor mechanism) or by the passage of water into and through the applicator's handle element.

18 Claims, 3 Drawing Sheets

FLEXIBLE HANDLE LIQUID DISPENSER WITH ROTATING BRUSH HEAD

RELATED APPLICATION

This application is a perfection of U.S. Provisional Application No. 61/674,377, filed on Jul. 22, 2012, the disclosure of which is fully incorporated by reference herein.

FIELD OF THE INVENTION

The present invention relates to hand held implements (or applicators) for applying soaps, cleansers or other liquids. This invention further relates to implements for a user to reach his/her own back or other hard-to-reach body areas for the self-application of soaps, lotions and/or other liquids thereto.

BACKGROUND INFORMATION

The following patents were found in a search relating to the present invention. Most noteworthy are the lotion applicator with bendable end and removably attachable pad from Abdo U.S. Pat. No. 5,671,497; adjustable body brush/massager of Miyaoka U.S. Pat. No. 4,508,108 and back applicator of Avolio U.S. Pat. No. 4,381,766.

In Wu U.S. Pat. No. 5,960,509, there is shown a multi-functional back brush having an adjustable shaft for pivoting about a central axle. A flexible elastomeric coupler joins an angularly-adaptable head to a rubber handled, tubular body in Black U.S. Pat. No. 6,546,588.

Maltese U.S. Pat. No. 5,530,983 showed a back brush with a generally U-shaped handle. Nazemi U.S. Pat. No. 5,528,792 had an axially-pivotable shower brush that rotates into one of two configurations. An older version of U-shaped back scrubber with bristles along the central curve was shown in Ellinger U.S. Pat. No. 2,318,680.

There are varying bath brushes like that in Edwards U.S. Pat. No. 4,184,221; Locher U.S. Pat. No. 3,935,611, Rhodes U.S. Pat. No. 3,568,237, and the disposable brush head of Nejdl U.S. Pat. No. 5,875,511. See also the back brush designs of Gelinas U.S. Design Pat. No. 389,319, Maltese U.S. Design Pat. No. 368,586 and Ryan U.S. Design Pat. No. 104,904.

In Viner U.S. Design Pat. No. 433,816, there is shown a design for a brush/soap dispenser combination. And in Smart et al. U.S. Published Patent Application No. 20040140326, a bath brush head is disclosed having an integral liquid soap dispenser reservoir. Finally, DeForest et al. U.S. Pat. No. 5,240,339 showed a body lotion applicator with a pivotally mounted head.

SUMMARY OF THE INVENTION

One embodiment of the present invention is an applicator for applying substances to hard-to-reach portions of a user's body. Preferably, that embodiment employs soft bristles. The applicator component of same comprises a handle having a first end configured to be gripped by a user and a second opposite, or brush head end having rotatable bristles. The handle element is flexible, and can be easily bent or manipulated into multiple straight or curved positions. It further includes an elongated central chamber into which may be added and stored soap, shampoo, cleaner or another liquid/lotion for dispensing through a plurality of apertures in the brush head end. Rotation of the brush head bristles can be accomplished electrically (via a battery powered motor mechanism) or by the passage of water into and through the applicator's handle element.

For non-body cleansing end uses, another embodiment of this invention would include harder bristles with an abrasive cleanser being stored in the applicator handle for eventual dispensing through apertures and onto a surface to be cleaned (i.e. scrubbed).

The handle portion of this liquid applicator may be formed in various ways to achieve a reasonable degree of bending. One version comprises a hollow metal core with an outer plastic covering. Alternate bendable, snakelike sections are also anticipated hereby.

The invention has a number of advantages and features discussed herein. Further objects will become apparent from the detailed description that follows.

BRIEF DESCRIPTION OF DRAWINGS

Further features, objectives and advantages will become clearer when reviewing the following detailed description of preferred embodiments made with reference to the accompanying drawings in which.

DESCRIPTION OF PREFERRED EMBODIMENTS

In the accompanying drawings, common elements are commonly numbered in the respective views. For the alternative embodiment, common elements are consistently numbered though in the next hundred series.

Figure 1:
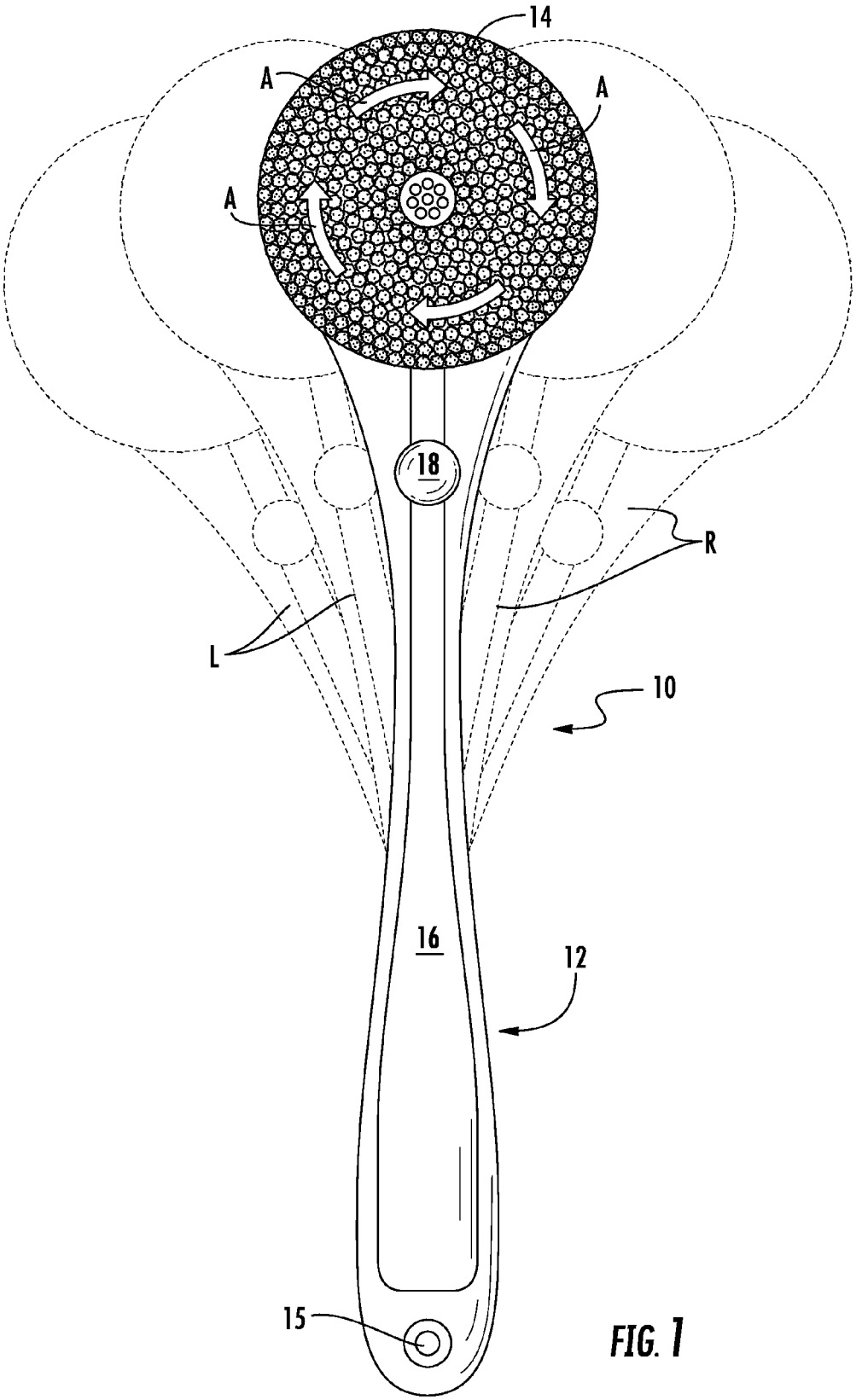
FIG. 1 is a front plan view of a first embodiment with alternate manipulation of the applicator head portion either to the left or right shown by silhouettes.
Figure 2:
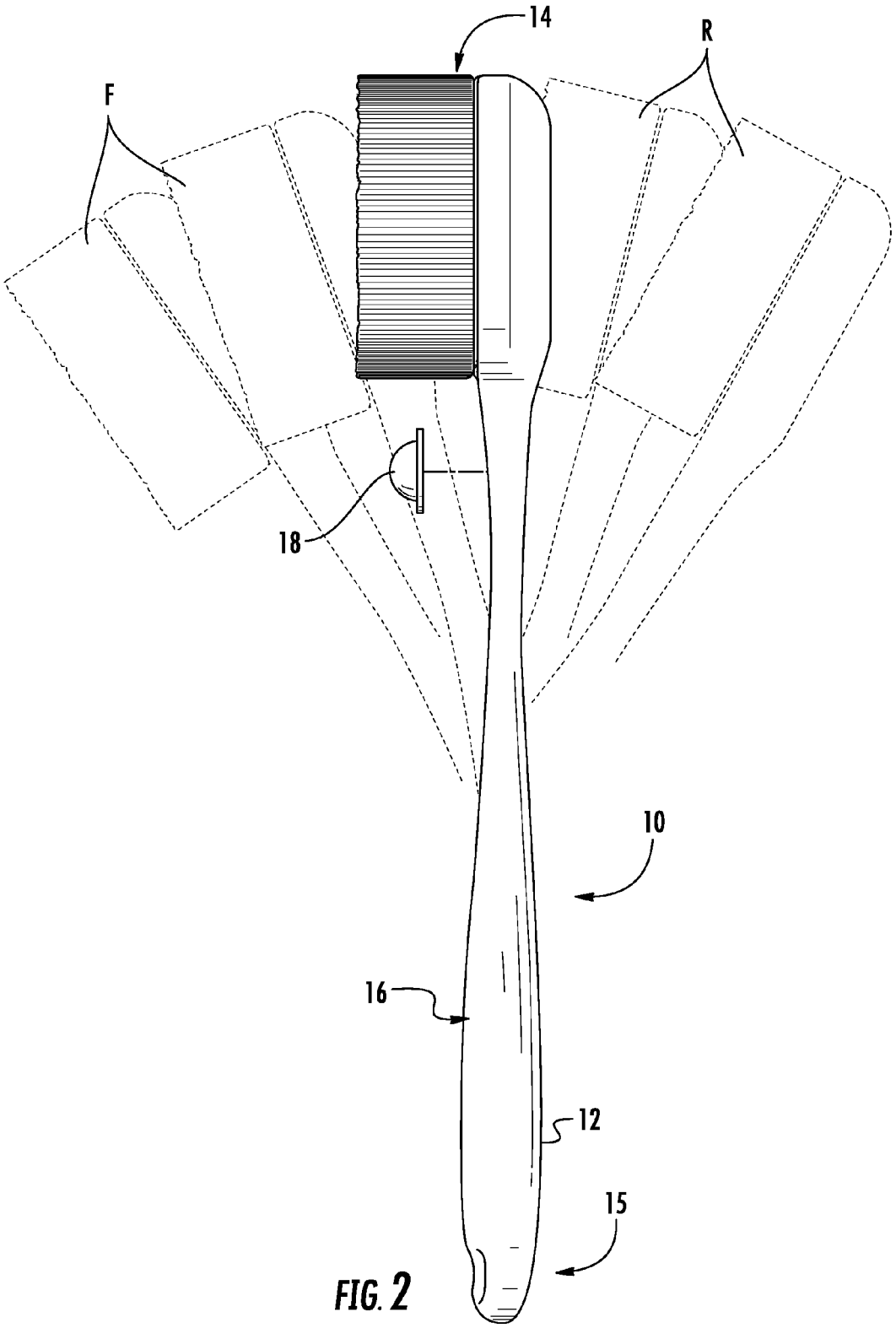
FIG. 2 is a side plan view of the embodiment from FIG. 1 showing alternate front or back (rear) head manipulation directions in adjacent silhouettes.

The subject invention is an applicator for applying lotion or another substance to areas on a user's body otherwise hard to reach. FIGS. 1 and 2 illustrate a first embodiment of basic applicator body, generally 10, having an elongated handle 12 with a rotating head 14 of bristles extending from one end of handle 12. Alternate embodiments of the body proper 10 may include optional elements such as a base aperture 15 for hanging the device to dry (when not in use). Though not shown, the handle 12 may further include contours, recesses or pre-molded finger indents from better gripping.

The direction of bristle rotation about head 14 is shown by arrows A. In FIG. 1, they are depicted are rotating in a clockwise direction. It is to be understood, however, that rotation in the reverse direction, i.e., counter-clockwise, may also suffice depending on the energy source (described below) for promoting bristle rotation about head 14.

Handle element 12 is intentionally flexible, and can be easily bent or manipulated into multiple straight or curved positions. In FIG. 1, silhouetted alternatives show the head 14 to brush handle flexed either to the left L or right R of a center position. In FIG. 2, alternate views show the brush head 14 flexed either to the front F (forward) or rear R (i.e., back of center).

The main body of this invention further includes an elongated central chamber, generally 16, into which may be added and stored soap, shampoo, cleaner or another liquid/lotion for dispensing through a plurality of apertures in the brush head end. Beneath brush head 14, towards the top of elongated handle 12, there is shown a pop-out cap 18. Once removed, the liquid for dispensing through this invention may be poured periodically into that handle, and refilled as needed, with storage of any unused portions in that chamber 16. A pop-out cap 18 is shown. It is to be understood, however, that alternative embodiments may include a screw in cap, a raised but not fully removed cap lid and many other alternatives.

Rotation of the brush head bristles can be accomplished electrically (via a battery powered motor mechanism). Though not shown, a rechargeable battery pack may be fitted into the brush body proper, most effectively behind the rotating head itself, using known waterproofing capabilities. Alternately, for smaller power applications, a motor may be included that runs on cell-type batteries stored in either the brush head or handle. In some instances, the brush body of this invention may be further combined with an electronically run liquid dispenser pump for more efficiently pulling soap, shampoo, cleaner or other liquid from its storage containment in the brush handle, then up and out apertures in the rotating brush head.

Figure 3:
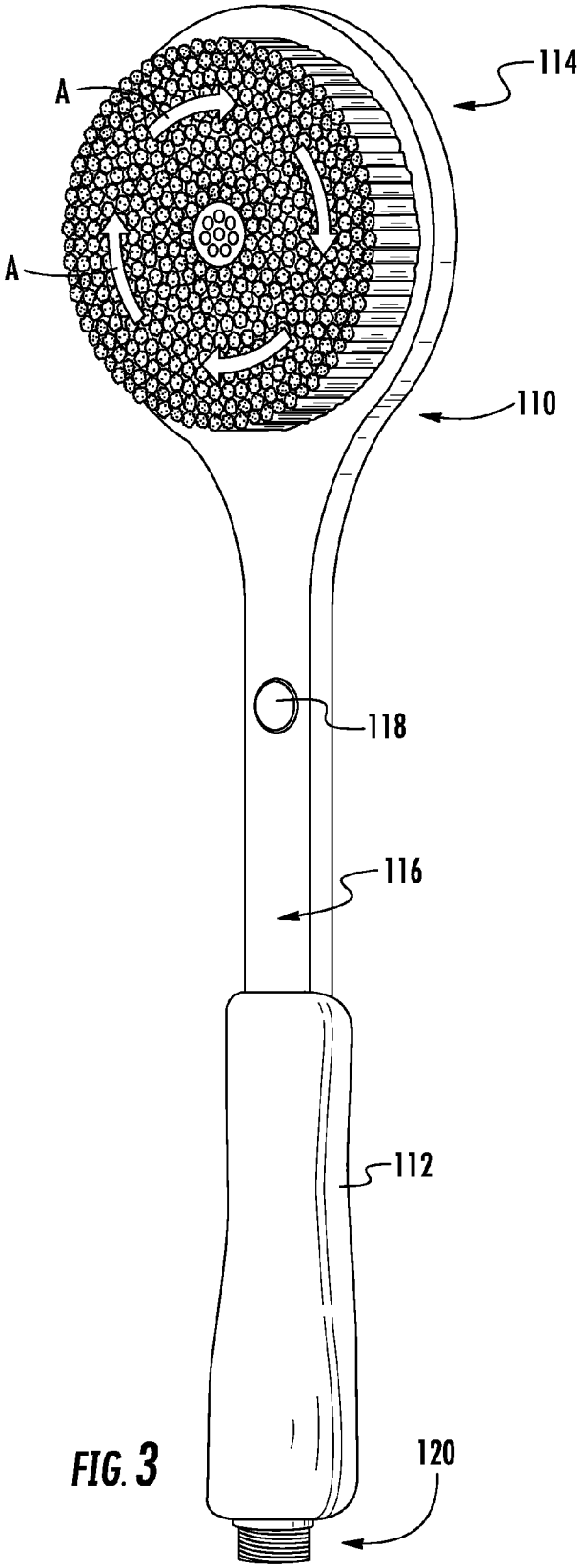
FIG. 3 is a front perspective view of a second embodiment according to this invention.

In FIG. 3, there is shown, in perspective view, a first alternative embodiment of applicator 110 wherein soap, shampoo, cleaner or other liquid in its brush handle 112 is carried up and through rotating head 114 by the passage of water into and through a hose-like nozzle connector 120 at the base to handle element 112. With the passage of water there through, that container will extract liquid from its storage/holding area 116, for pulling up through the handle proper and dispensing outwardly through apertures in rotating brush head 114.

Depending on intended end use, the brush head of this invention may be fitted with soft bristles for causing less irritation to the user's skin being serviced therewith. Or, for other appliance/plumbing/floor cleaning applications, where a stronger, more abrasive contact is preferred, that family of brush heads may employ harder bristles.

In all embodiments, the foregoing handle element can also be made to telescope inwardly/outwardly for allowing for some lateral extension/elongation, if needed. Also, a rubberized grip may be installed over one end. More preferably, one or more handle hanging means may be added.

FIG. 1 illustrates a bending of the applicator handle in either lateral direction. It is not meant to indicate that the handle hereof wobbles back and forth (like the motion of a fly swatter) when in use. Instead, it can be pre-shaped in either a left or right direction (and/or in a front-to-rear adjustment, as seen via FIG. 2) depending on the reaching area needs of its user.

The applicator of the invention, and particularly the preferred embodiment thereof, has a number of advantages. It is easy and economical to manufacture. It is also durable and highly versatile to use.

Preferred characteristics of the bristle head allow soap, cleanser or other lotion to be efficiently and easily applied to the body while maintaining easy cleaning and minimizing liquid waste. For a user, the applicator is easy to assemble, use, and maintain.

Although preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A brush applicator for applying a liquid to a hard-to-reach surface, said applicator comprising:

a handle having a first end configured to be gripped and pre-shaped by a user, said handle having: (i) a refillable containment region in which the liquid may be stored for use; and (ii) a manipulatable region for firmly bending in a plurality of positions for applying the liquid to the surface while in said position; and a brush head at or near one end of the handle, said brush head having: a plurality of bristles that are powered to rotate in at least one direction; and one or more apertures through which the liquid from the handle is dispensed.

2. The brush applicator of claim 1 wherein said hard-to-reach surface is an area needing to be cleaned with the liquid.

3. The brush applicator of claim 2 wherein said hard-to-reach surface is a mammal's body part.

4. The brush applicator of claim 2 wherein said hard-to-reach surface is part of a human body.

5. The brush applicator of claim 1 wherein said manipulatable region enables the user to bend the handle to the left or right of center.

6. The brush applicator of claim 1 wherein said manipulatable region enables the user to bend the handle to the front or rear of center.

7. The brush applicator of claim 1 wherein the bristles of the brush head are electrically powered to rotate in at least one direction.

8. The brush applicator of claim 7 wherein the bristles of the brush head are electrically powered to rotate in a plurality of speeds.

9. The brush applicator of claim 1 wherein the bristles of the brush head are hydraulically powered to rotate in at least one direction.

10. A dispenser for applying a liquid substance to hard-to-reach portions of a human body, said dispenser comprising:

a handle having a first end configured to be gripped and pre-shaped by a user, said handle having: (i) a refillable containment region in which the liquid substance may be stored for use; and (ii) a flexible region for firmly bending into one or more positions for applying the liquid substance to the human body; and a brush head at or near one end of the handle, said brush head having: a plurality of bristles that are powered to rotate in at least one direction; and a plurality of apertures through which the liquid substance in the containment region of the handle is dispensed.

11. The liquid dispenser of claim 10 wherein said flexible region enables the user to bend the handle to the left or right of center.

12. The liquid dispenser of claim 10 wherein said flexible region enables the user to bend the handle to the front or rear of center.

13. The liquid dispenser of claim 10 wherein the bristles of the brush head are electrically powered to rotate in at least one direction.

14. The liquid dispenser of claim 13 wherein the bristles of the brush head are electrically powered to rotate in a plurality of speeds.

15. The liquid dispenser of claim 10 wherein the bristles of the brush head are hydraulically powered to rotate in at least one direction.

16. The liquid dispenser of claim 10 wherein the bristles of the brush head can be soft or hard for human skin contact.

17. A flexible applicator for applying a liquid cleaning substance to a hard-to-reach area of a human body, said applicator comprising:

a handle having a first end configured to be gripped by the user, said handle having: (i) a refillable containment region in which the liquid cleaning substance may be stored for use; and (ii) a region for firmly pre-shaping into one or more curved positions, left or right and/or front-to-rear, for applying the liquid substance to the hard-to-reach area of the human body; and a brush head at or near one end of the handle, said brush head having a plurality of bristles that are electrically or hydraulically powered to rotate in at least one direction and multiple apertures at or near a center of the brush head through which the liquid cleaning substance from the handle is dispensed.

18. The flexible applicator of claim 17 wherein said liquid cleaning substance is a liquid soap.

* * * * *